US008019251B2

(12) United States Patent
Yamada et al.

(10) Patent No.: US 8,019,251 B2
(45) Date of Patent: Sep. 13, 2011

(54) ANGULAR POSITION ADJUSTING APPARATUS, ANGULAR POSITION ADJUSTING METHOD, AND COMPUTER-READABLE RECORDING MEDIUM FOR ANGULAR POSITION ADJUSTMENT

(75) Inventors: Kenichi Yamada, Kanagawa (JP); Kazuo Koike, Kanagawa (JP); Tasuku Kohara, Kanagawa (JP); Takashi Inoue, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 489 days.

(21) Appl. No.: 11/519,917

(22) Filed: Sep. 13, 2006

(65) Prior Publication Data

US 2007/0059032 A1 Mar. 15, 2007

(30) Foreign Application Priority Data

Sep. 15, 2005 (JP) ..... 2005-269215

(51) Int. Cl.
*G03G 15/00* (2006.01)

(52) U.S. Cl. ..... 399/107; 399/81

(58) Field of Classification Search ..... 399/107, 399/110, 81
See application file for complete search history.

(56) References Cited

U.S. PATENT DOCUMENTS

| | | | | |
|---|---|---|---|---|
| 4,618,870 | A | 10/1986 | Inoue | 347/182 |
| 4,639,741 | A | 1/1987 | Inoue | 347/182 |
| 4,675,697 | A | 6/1987 | Sasaki et al. | 347/175 |
| 2002/0140687 | A1 * | 10/2002 | Takeda | 345/204 |
| 2003/0218643 | A1 * | 11/2003 | Sakata et al. | 345/865 |
| 2005/0185216 | A1 * | 8/2005 | Mitsuhashi et al. | 358/1.15 |
| 2006/0164801 | A1 * | 7/2006 | Yoo | 361/683 |
| 2006/0171734 | A1 * | 8/2006 | Maeda | 399/81 |

FOREIGN PATENT DOCUMENTS

| | | | |
|---|---|---|---|
| JP | 2002361968 | A * | 12/2002 |
| JP | 2003-337506 | | 11/2003 |
| JP | 2003-345087 | | 12/2003 |
| JP | 2004-287453 | | 10/2004 |

* cited by examiner

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

An angular position adjusting apparatus for adjusting the angular position of a control panel of an image processing apparatus is disclosed that includes a rotary member attached to the control panel, an input part for generating an input signal indicative of changing the angular position of the control panel, a motor part connected to the rotary member for changing the angular position of the control panel by driving the rotary member, and a setting part for setting the angular position of the control panel in correspondence with the power status of the image processing apparatus.

9 Claims, 16 Drawing Sheets

ANGULAR POSITION ADJUSTING APPARATUS, ANGULAR POSITION ADJUSTING METHOD, AND COMPUTER-READABLE RECORDING MEDIUM FOR ANGULAR POSITION ADJUSTMENT

BACKGROUND OF THE INVENTION

1. Field of the Invention

The present invention relates to an angular position adjusting apparatus, an angular position adjusting method, and a computer-readable recording medium for angular position adjustment, and more particularly, to an angular position adjusting apparatus, an angular position adjusting method, and a computer-readable recording medium for angular position adjustment for adjusting the angular position of a control panel of, for example, an image forming apparatus.

2. Description of the Related Art

In recent years and continuing, the use of image forming apparatuses such as copiers (e.g. electrophotographic type copy machines), facsimiles, printers, plotters, and printing machines is rapidly increasing. In controlling image forming apparatuses, a control part of an image forming apparatus includes various input and output apparatuses such as a control panel including, for example, a control button(s) for inputting data (e.g. hard key such as a switch, soft key such as a touch panel), and a display for displaying status information and instructions from the image forming apparatus (e.g. LED, LCD). In some cases of using the control part, there may be difficulty in operating the control part due to physical characteristics of the user (operator), such as height or difficulty in viewing the display due to lighting or external light.

In order to solve such difficulties, various mechanisms for changing the angular position of the control part or the display are proposed (For example, Japanese Laid-Open Patent Application Nos. 2003-345087, 2003-337506, and 2004-287453). Such mechanisms include, for example, a control panel protruding from a main body of an apparatus for allowing the angular position of the control panel to be adjusted. Another mechanism includes a component that applies load (e.g. friction) to a member such as a rotary axle or a joint part provided by a ratchet mechanism.

However, with an image forming apparatus having the protruding control panel, the position of the control panel does not change and remains in the protruding state once the electric power of the image forming apparatus is turned off. From the aspect of safety or efficient utilization of space, it is preferable to change the position of the control panel when the image forming apparatus is not in use. With the image forming apparatus having the rotary axle or the joint part, the rotary axle or the joint part of the control part may undesirably rotate in a case where too much force applied upon operating the control part or where the joint part is weakly affixed to the control part. Accordingly, a large operating force or complicated operation (e.g. adjusting the rotary angle of the control part by removing the ratchet mechanism) may be required for the user (particularly, in a case where the user is a child, an elderly person, or a physically impaired person).

SUMMARY OF THE INVENTION

The present invention may provide an angular position adjusting apparatus, an angular position adjusting method, and a computer-readable recording medium for angular position adjustment that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an angular position adjusting apparatus, an angular position adjusting method, and a computer-readable recording medium for angular position adjustment particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an angular position adjusting apparatus for adjusting the angular position of a control panel of an image processing apparatus, the angular position adjusting apparatus including: a rotary member attached to the control panel; an input part for generating an input signal indicative of changing the angular position of the control panel; a motor part connected to the rotary member for changing the angular position of the control panel by driving the rotary member; and a setting part for setting the angular position of the control panel in correspondence with a power status of the image processing apparatus.

In the angular position adjusting apparatus according to an embodiment of the present invention, the setting part may set the angular position of the control panel to a maximum tilt angle in a case of turning off the power of the image processing apparatus.

In the angular position adjusting apparatus according to an embodiment of the present invention, the setting part may set the angular position of the control panel to a reference position angle in a case of turning on the power of the image processing apparatus.

In the angular position adjusting apparatus according to an embodiment of the present invention, the setting part may set the angular position of the control panel to a predetermined angular position in a case of turning on the power of the image processing apparatus.

In the angular position adjusting apparatus according to an embodiment of the present invention, the angular position adjusting apparatus may further include a memory part for storing data of the angular position of the control panel before the power of the image processing apparatus is turned off, wherein the data includes data of the predetermined angular position.

In the angular position adjusting apparatus according to an embodiment of the present invention, the input part may be situated on at least one of an upper surface of the control panel and a lower surface of the control panel, wherein the input part generates the input signal in accordance with a pressing force applied from an operator of the image processing apparatus.

In the angular position adjusting apparatus according to an embodiment of the present invention, the angular position adjusting apparatus may further include: an angle position detecting part including a position sensor for detecting at least one angular position of the control panel; a stop position detecting part for determining whether the angular position of the control panel has reached a predetermined angular position; an input signal detecting part for detecting the input signal generated from the input part; and a motor driving part for driving the motor in accordance with the input signal detected by the input signal detecting part.

Furthermore, the present invention provides a method for adjusting the angular position of a control panel of an image processing apparatus, the method including the steps of: a) generating an input signal indicative of changing the angular position of the control panel; b) changing the angular position of the control panel by driving a rotary member attached to the control panel; and c) setting the angular position of the control panel in correspondence with a power status of the image processing apparatus.

In the angular position adjusting method according to an embodiment of the present invention, step c) may set the angular position of the control panel to a maximum tilt angle in a case of turning off the power of the image processing apparatus.

In the angular position adjusting method according to an embodiment of the present invention, step c) may set the angular position of the control panel to a reference position angle in a case of turning on the power of the image processing apparatus.

In the angular position adjusting method according town embodiment of the present invention, step c) may set the angular position of the control panel to a predetermined angular position in a case of turning on the power of the image processing apparatus.

In the angular position adjusting method according to an embodiment of the present invention, the angular position adjusting method may further include a step of: storing data of the angular position of the control panel before the power of the image processing apparatus is turned off; wherein the data includes data of the predetermined angular position.

In the angular position adjusting method according to an embodiment of the present invention, step a) may generate the input signal in accordance with a pressing force applied from an operator of the image processing apparatus.

In the angular position adjusting method according to an embodiment of the present invention, the angular position adjusting method may further include the steps of: detecting at least one angular position of the control panel; determining whether the angular position of the control panel has reached a predetermined angular position; detecting the input signal generated from the input part; and driving the motor in accordance with the input signal detected in the step of detecting the input signal.

Furthermore, the present invention provides a computer-readable recording medium on which a program is recorded for causing a computer to execute an angular position adjusting method for adjusting the angular position of a control panel of an image processing apparatus, the angular position adjusting method including the steps of: a) generating an input signal indicative of changing the angular position of the control panel; b) changing the angular position of the control panel by driving a rotary member attached to the control panel; and c) setting the angular position of the control panel in correspondence with a power status of the image processing apparatus.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
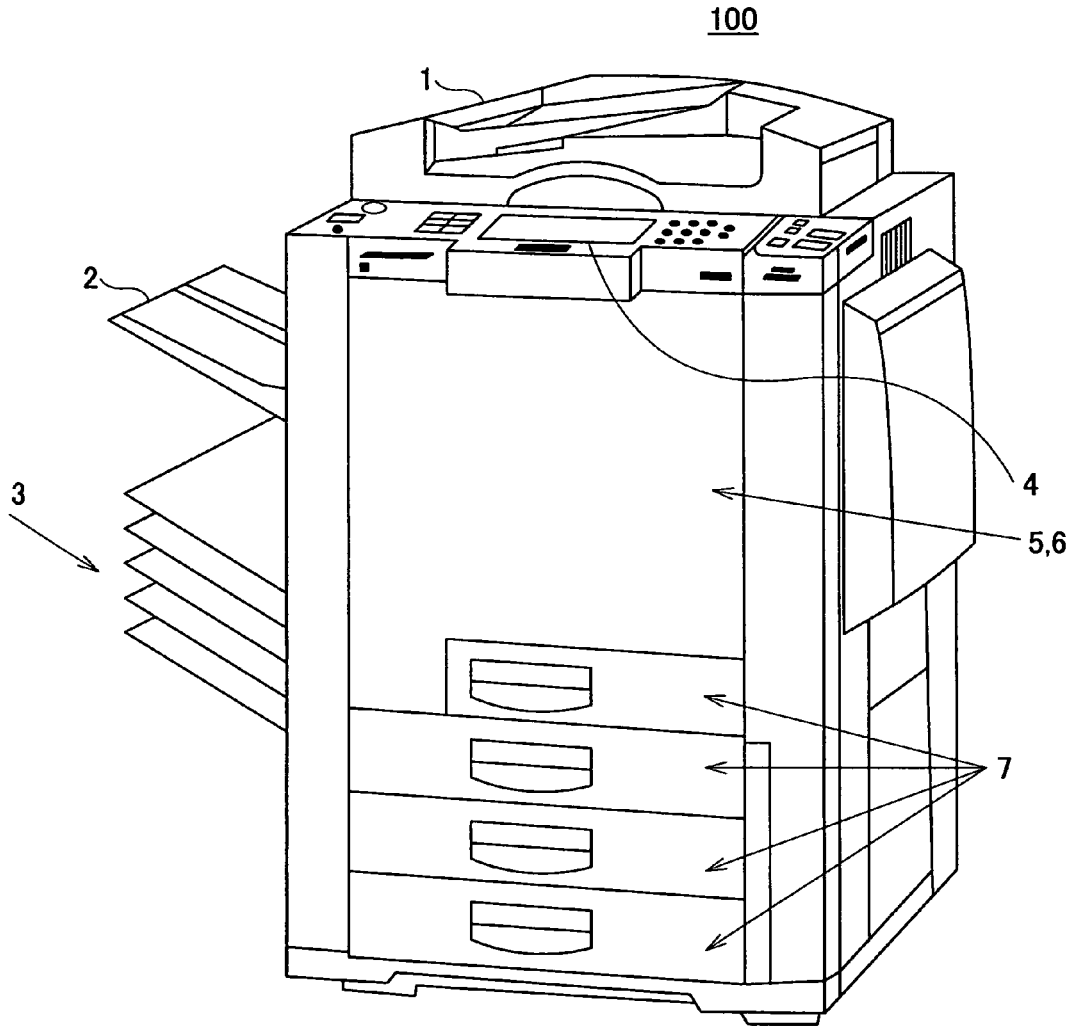
FIG. 1 is a schematic view of an image processing apparatus according to an embodiment of the present invention.

FIG. 1 is a schematic diagram showing an image processing apparatus 100 according to an embodiment of the present invention. As shown in FIG. 1, the main body of the image processing apparatus 100 includes, for example, an ADF (Automatic Document Feeder) 1 for delivering an original document (target document) placed thereon to a scanning portion, a scanner 5 (not shown since it is mounted inside the main body of the image processing apparatus 100) for reading data (e.g. image data, text data) from the original document, a printer 6 (not shown since it is mounted inside the main body of the image processing apparatus 100) for printing out the data read by the scanner 5, a paper tray 7, a control part (control panel) 4, a paper discharge tray 2, and a sorter 3 for sorting the printed paper.

Figure 2:
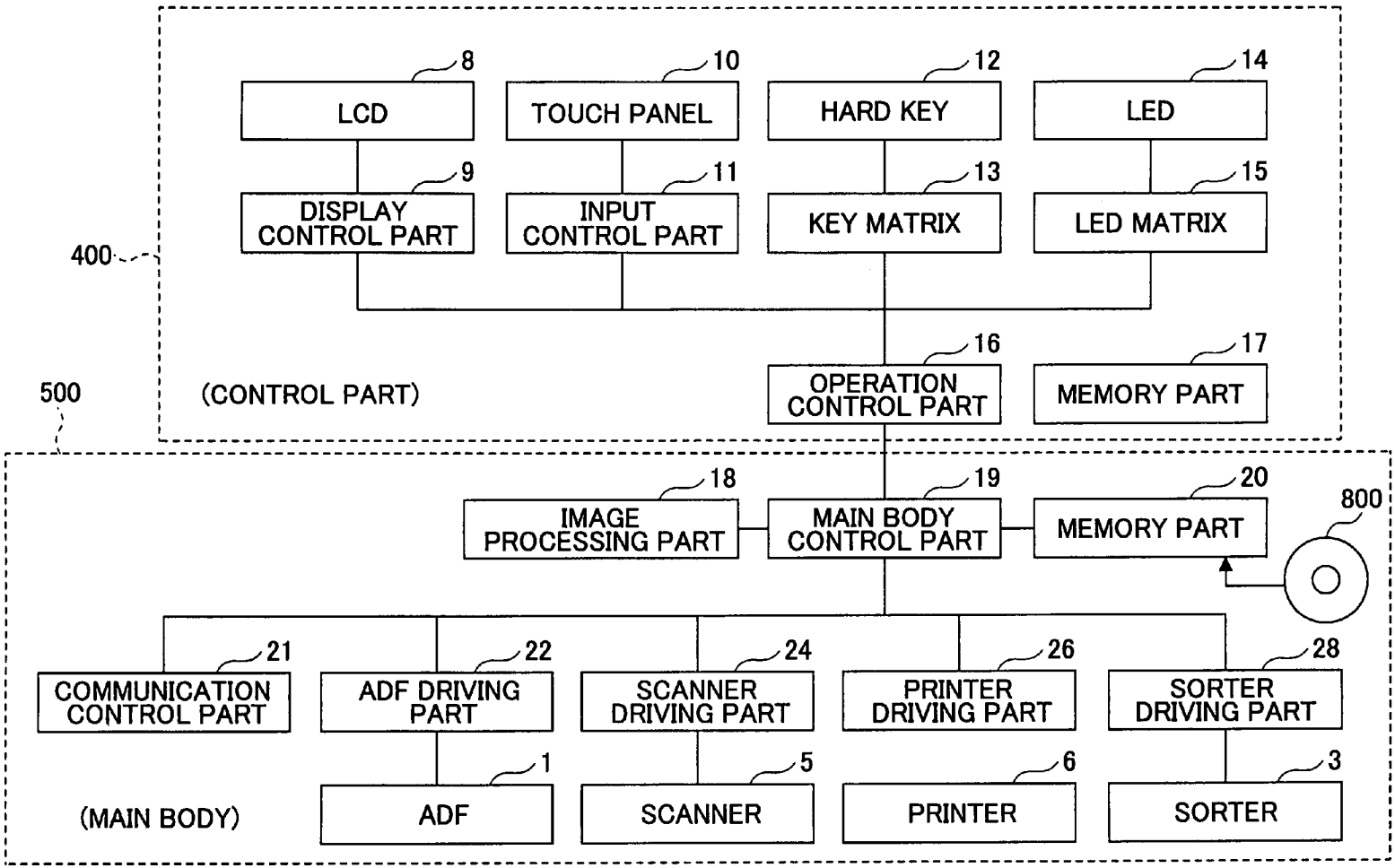
FIG. 2 is a diagram showing basic control blocks of an image processing apparatus according to an embodiment of the present invention.

FIG. 2 is a diagram showing basic control blocks of the image processing apparatus 100 according to an embodiment of the present invention. The upper part of FIG. 2 shows control blocks included in the control part 400, and the lower part of FIG. 2 shows the control blocks included in the main body of the image processing apparatus 1. The control part 400, which is configured to input and display various controls and operations, includes hard keys (e.g. switch, button), soft keys (e.g. touch panel), and display devices (e.g. LED, LCD). More specifically, the control part 400 includes, for example, an LCD 8, a display control part 9, a touch panel 10, an input control part 11, a hard key 12, a key matrix 13, an LED 14, an LED matrix 15, an operation control part 16, and a memory part 17. The operation control part 16 performs overall control of the above-described control blocks such as the display control part 9 and the input control part 11. The operation control part 16 also communicates with the memory part 17 and a main body control part 19 in the main body for exchanging input information and display data. The main body of the image processing apparatus 100 includes, for example, an image processing part 18, the main body control part 19, a memory part 20, a communication control part 21, an ADF driving part 22, the ADF 1, a scanner driving part 24, the scanner 5, a printer driving part 26, the printer 6, a sorter driving part 28, and the sorter 3. The memory part 20 stores, for example, a program for sequence control executed by the main body control part 19 and a file for construing input signals from the control part 400. The image processing part 18 is for performing, for example, image processing (e.g. UCR (Under Color Removal), contour enhancement, expansion/reduction) on image data read by the scanner 5. The communication control part 21 is for performing, for example, communications of image data via LAN or facsimile.

Figure 3B:
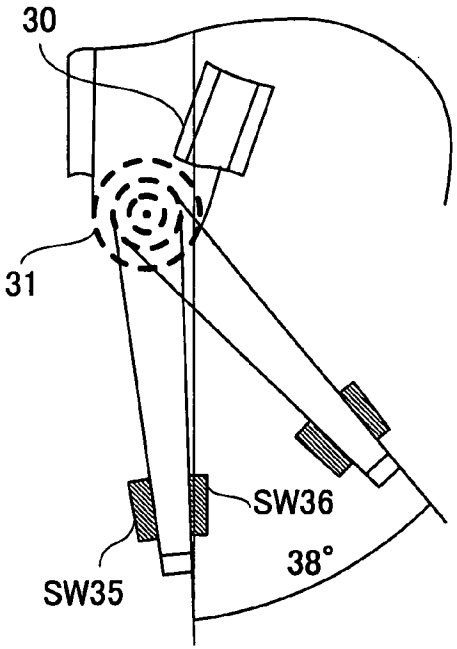
FIG. 3B is a side view of a control part according to an embodiment of the present invention.
Figure 3A:
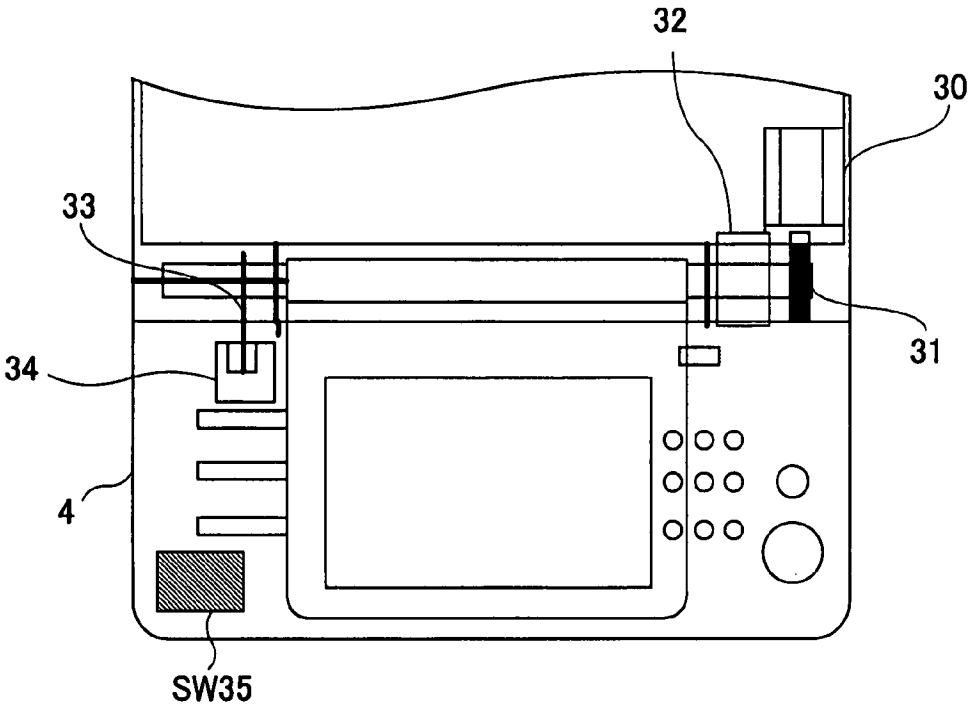
FIG. 3A is a front view of a control part according to an embodiment of the present invention.
Figure 4:
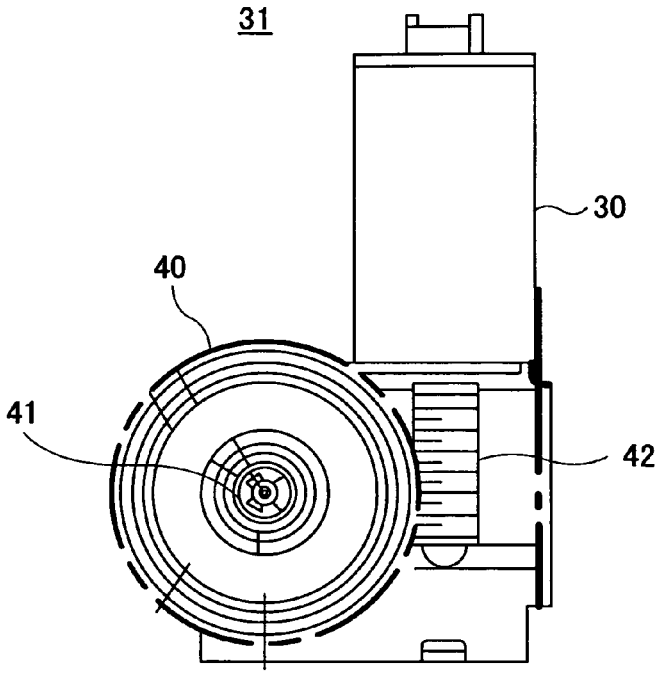
FIG. 4 is a side view of a deceleration mechanism according to an embodiment of the present invention.

FIGS. 3A and 3B are schematic diagrams showing the control part 400 according to an embodiment of the present invention. FIG. 3A is a front view of the control part 400, and FIG. 3B is a side view of the control part 400. FIG. 4 is a side view of a deceleration mechanism 31 according to an embodiment of the present invention. The control part 400 includes, for example, an input part such as a switch (in this embodiment, tilt switch (SW) 35, tilt switch (SW) 36) for rotating the control part 400 in accordance with a pressing force applied thereto, a rotary axle 41 (See FIG. 4), a motor 30, the deceleration mechanism 31, a latch mechanism 32, a position detecting plate 33, a photo-interpreter 34, and a control panel 4.

In a case where the operator desires to tilt the control part 400 downward, a switch (tilt SW 35) provided at the upper surface of the control part 400 is pressed downward to generate an input signal indicating downward oscillation. The control part 400 determines that such downward pressing maneuver (downward oscillation) is a downward tilt instruction and generates a detection signal in response to the downward pressing maneuver. In a case where the operator desires to tilt the control part 400 upward, a switch (tilt SW 36) provided at the lower surface of the control part 400 is pressed upward to generate an input signal indicating upward oscillation. The control part 400 determines that such upward pressing maneuver (upward oscillation) is an upward tilt instruction and generates a detection signal in response to the upward pressing maneuver. The motor 30 is rotated in accordance with the detection signals and rotates in the direction desired by the operator.

Thereby, the operator according to this embodiment of the present invention can perform both the downward oscillation and the upward oscillation of the control part 400 in a similar manner. Furthermore, the control part 400 can be stopped at a position desired by the operator. Accordingly, the accuracy of position control of the control part 400 can be improved.

Since the rotary axle 41 of the control part 400 is connected to the motor 30 via the deceleration mechanism 31, the deceleration mechanism 31 enables the control part 400 maintain its angular position. Accordingly, even if the operator attempts to rotate the control part 400 by pressing the control part 400, the control part 400 cannot be easily rotated unless the motor 30 is driven. The latch mechanism 32 is provided between the deceleration mechanism 31 and the rotary axle 41 of the control part 400. The latch mechanism 32 is configured to open (release) when the motor 30 is driven and latch (close) when the motor 30 is stopped for ensuring a latched state of the control part 400. By employing the latch mechanism 32, the gear 40 of the deceleration mechanism 31 can be prevented from shaking the control panel 4.

Figure 6:
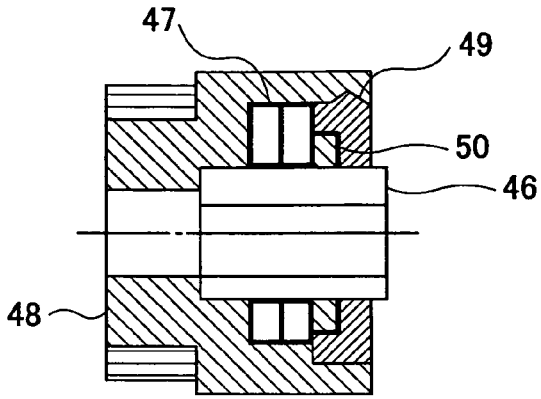
FIG. 6 is a cross-sectional view of a torque hinge according to an embodiment of the present invention.

An example of the latch mechanism 32 is a torque hinge as shown in FIG. 6. The latch mechanism 32 shown in FIG. 6 includes a bearing 46 fixed to the rotary axle 41 and a housing 48 fixed to the main body. A flat spring 47 of the latch mechanism 32 is configured to provide holding strength by generating frictional force between the rotary axle 41 and the housing 48.

Figure 8:
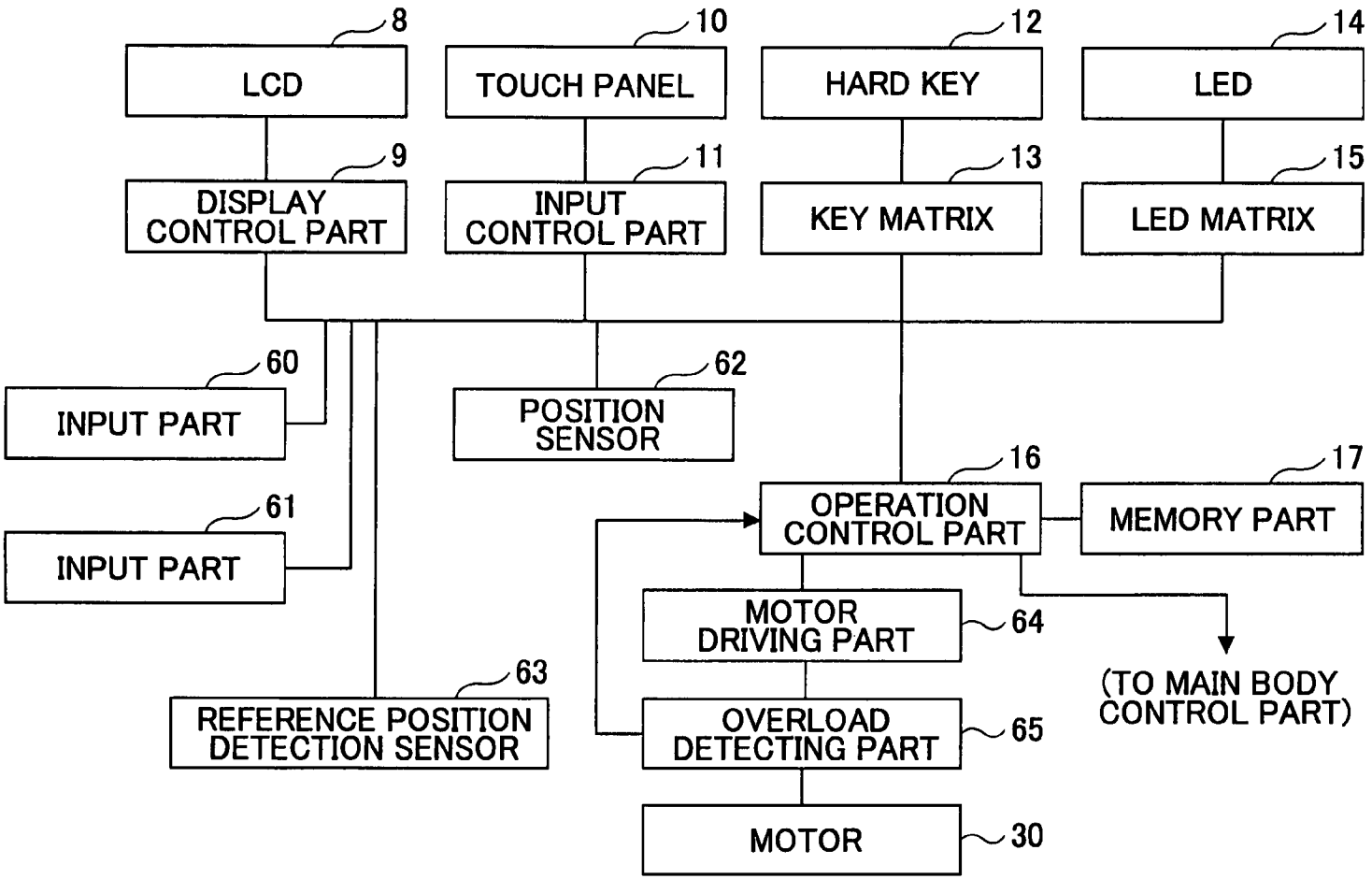
FIG. 8 is a diagram showing control blocks of a control part according to an embodiment of the present invention.
Figure 9:
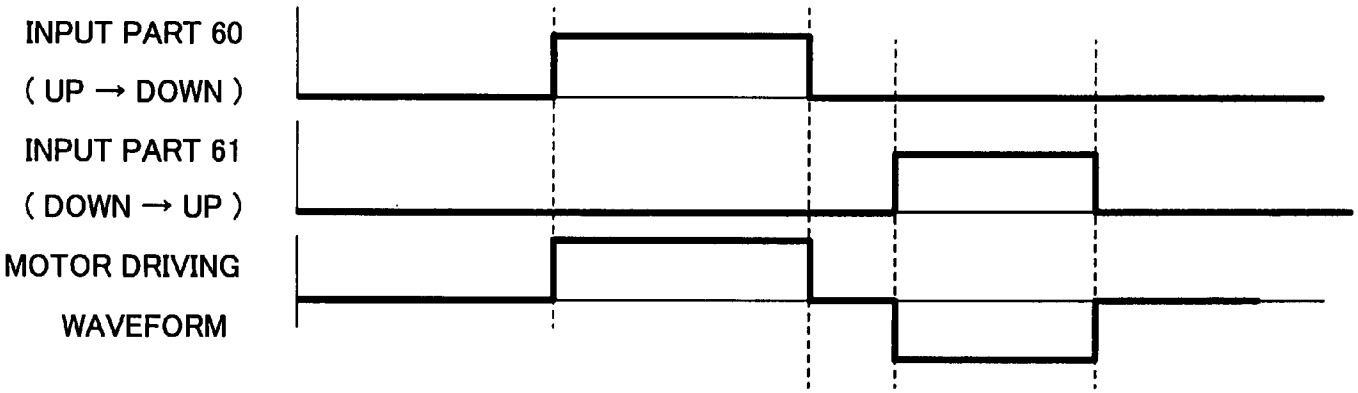
FIG. 9 is a timing chart of a control signal for driving a motor according to an embodiment of the present invention.

FIG. 8 is a diagram showing control blocks of the control part 400 according to an embodiment of the present invention. The LCD 8, the display control part 9, the touch panel 10, the input control part 11, the hard key 12, the key matrix 13, the LED 14, and the LED matrix 15, the operation control part 16, and the memory part 17 shown in FIG. 8 are the same as those shown in FIG. 2, and the motor 30 shown in FIG. 8 is the same as that shown in FIG. 3. As for other control blocks, the control part 400 according to an embodiment of the present invention also includes, for example, input parts 60, 61 (which include the switches SW35, SW36), a position sensor 62, a reference position detection sensor 63, a motor driving part 64, and a overload detecting part 65. In a case where input from one of the input parts 60, 61 is detected, the operation control part 16 determines whether the input is from the input part 60 or the input part 61. Then, the operation control part 16 outputs a motor driving signal and an instruction signal indicative of the rotation direction of the motor to the motor driving part 64 in accordance with the determination. The waveform of the output signal is shown in FIG. 9.

Figure 10:
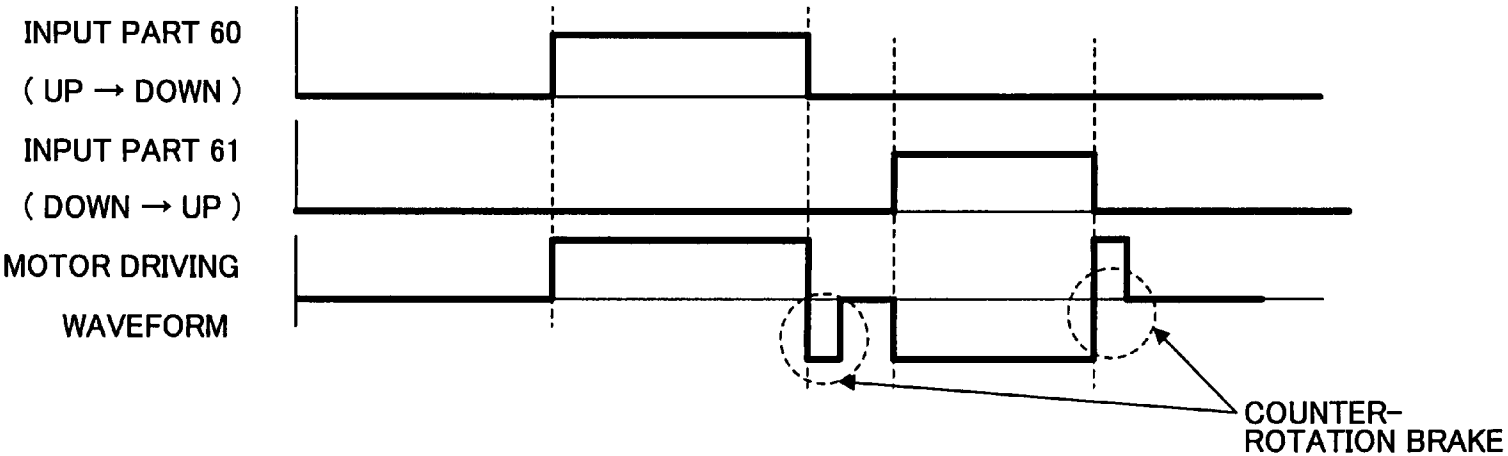
FIG. 10 is a timing chart of a control signal for driving a motor according to an embodiment of the present invention in a case where a counter-rotation braking force is applied to the motor.

Furthermore, since the rotary axle 41 of the control panel 4 is connected to the motor 30 via the deceleration mechanism 31, an increase of inertia of the motor 30 and the deceleration mechanism 31 may cause the control panel 4 to continue rotating even after the pressing force applied to the control panel 4 is lifted. Thereby, in some cases, the control panel 4 may be rotated in excess. Accordingly, the control panel 4 may be provided with a stopping apparatus (e.g. brake) for immediately stopping the rotation of control panel 4 after the applying of pressing force is stopped. The brake (method of applying a braking force) may include, for example, an electromagnetic brake or a counter-rotation brake that applies negative phase voltage to the motor 30. FIG. 10 shows a control waveform in a case where a counter-rotation force applied to the motor 30 according to an embodiment of the present invention. As for other methods of applying a braking force, a braking force may be creating by causing a short circuit with respect to a terminal of the motor 30. For example, the terminal of the motor 30 may short-circuited at the timing of the counter-rotation brake shown in FIG. 10.

Figure 7:
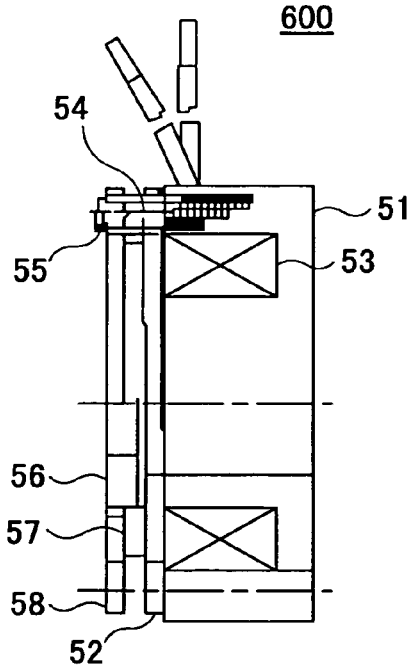
FIG. 7 is a schematic view of an electromagnetic brake according to an embodiment of the present invention.

FIG. 7 is a schematic diagram showing an electromagnetic brake 600 according to an embodiment of the present invention. The electromagnetic brake 600 includes, for example, a yoke 51, an armature 52, a coil 53, a pin spring 54, a pole 55, a hub 56, a disk 57, and a plate 58. The yoke 51 and the armature 52 form a magnetic circuit. The yoke 51 has the coil 53 provided therein. In the magnetic circuit, the yoke 51 attracts the armature 52 with magnetic force when electric power is provided to the coil 53, to thereby applying braking force by the frictional force in a prescribed direction. In this example, the yoke 51 is mounted on the main body, and the armature 52 is mounted on the rotary axle 41. Accordingly, a frictional braking force can be provided when electric power is applied to the coil 53. In a case of no dielectric, the armature 52 can freely rotate together with the rotary axle 41.

Figure 11:
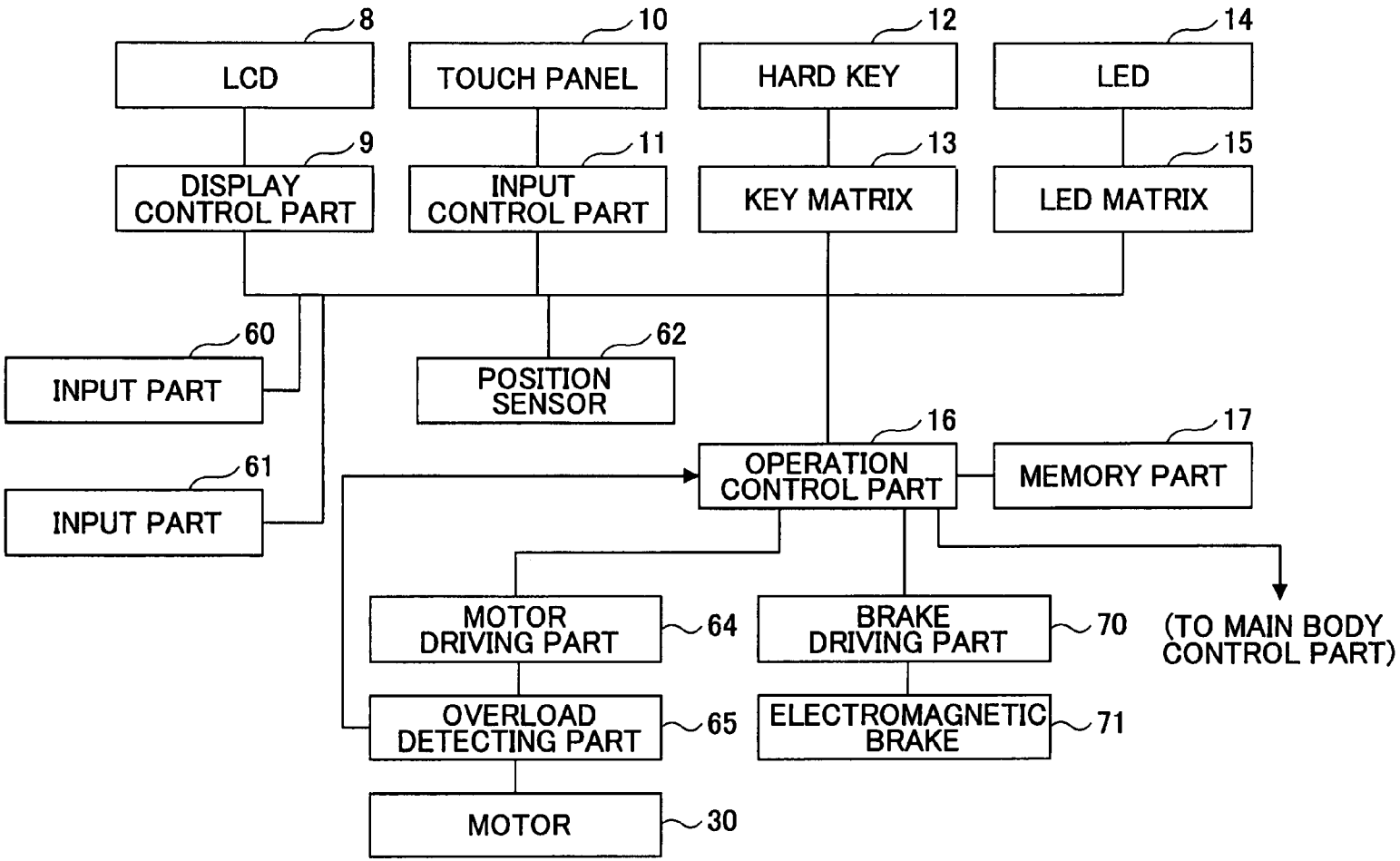
FIG. 11 is a diagram showing control blocks of a control part in a case where an electromagnetic brake according to an embodiment of the present invention is used.
Figure 12:
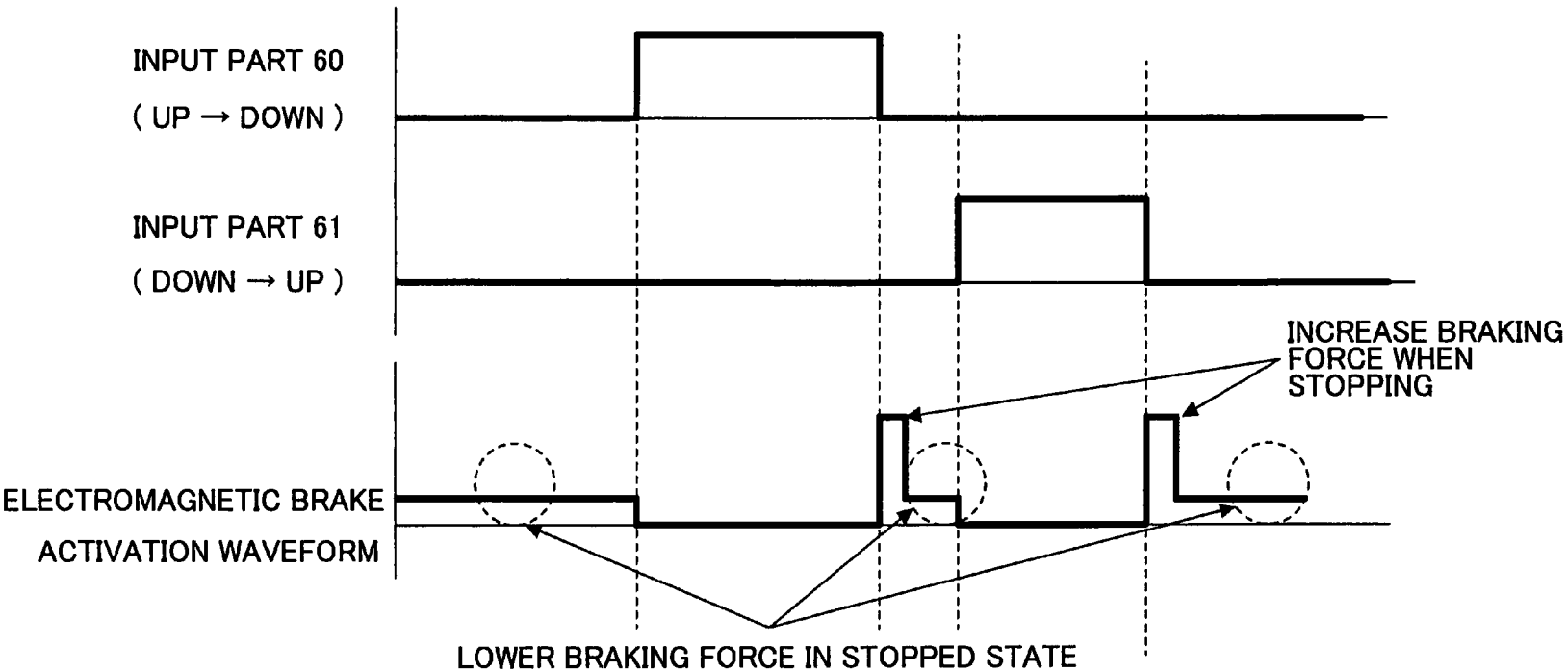
FIG. 12 is a timing chart showing a waveform of a braking force of an electromagnetic brake applied in a case of stopping a motor according to an embodiment of the present invention.

FIG. 11 is a diagram showing control blocks of the control part 400 in a case where an electromagnetic brake 71 according to an embodiment of the present invention is used. FIG. 12 shows a waveform of the braking force of the electromagnetic brake 71 applied in a case of stopping the motor. The LCD 8, the display control part 9, the touch panel 10, the input control part 11, the hard key 12, the key matrix 13, the LED 14, and the LED matrix 15, the operation control part 16, the memory part 17, the motor 30, the input parts 60, 61, the position sensor 62, the motor driving part 64, and the overload detecting part 65 shown in FIG. 11 are the same as those shown in FIG. 8. As for other control blocks, the control part 400 shown in FIG. 11 also includes, for example, the electromagnetic brake 71 and a brake driving part 70 for driving the electromagnetic brake 71. The brake driving part 70 is controlled by the operation control part 16.

In activating (driving) the electromagnetic brake 71, the electromagnetic brake 71 is supplied with power (energized) immediately after the motor 30 is stopped and is opened immediately before the motor 30 is driven. In this process, the electromagnetic brake 71 is energized with a rated power for a predetermined period immediately after the motor 30 is stopped (power greater than the rated power may be supplied if the predetermined period is short). After the predetermined period has elapsed, the energizing of the electromagnetic brake 71 is controlled in a manner that the power applied to the electromagnetic brake decreases. This control is conducted since a sufficient frictional force can be attained without the supply of rated power given that the magnetic reluctance decreases as the air gap between the armature 52 and the yoke 51 becomes smaller when the armature 52 is attracted to the yoke 51. Accordingly, consumption of electric power can be reduced and heating of the electromagnetic brake 71 can be controlled.

In another example of the present invention, the angular stop position of the control part 400 may be set so that the control part 400 can be stopped at plural positions (steps) instead of stopping at a single predetermined position. In this example, a position sensor(s) 62 is employed for detecting a stop position mark(s) provided to the rotary axle 41 of the control part 400, to thereby stop the control part 400 upon detection of the stop position.

Figure 5:
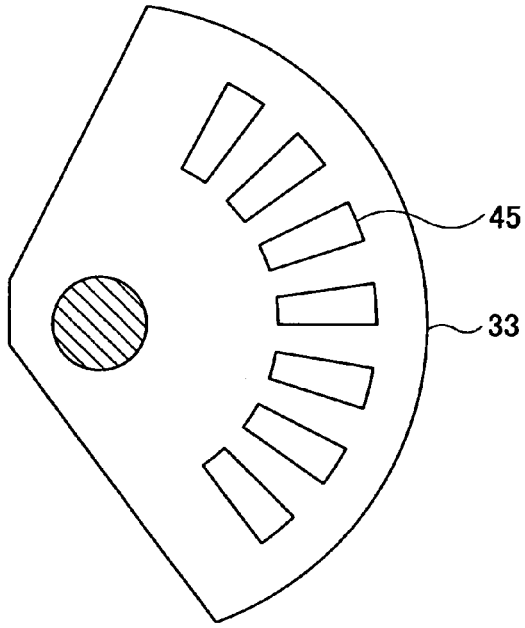
FIG. 5 is a schematic diagram of a position detecting plate according to an embodiment of the present invention.

With reference to FIGS. 3A, 3B, and 4, the position detecting plate 33 (in this example, the position detecting plate 33 is shaped as a circular arc) is mounted to the rotary axle 41 that supports the control panel 4. As shown in FIG. 5, substantially rectangular shaped slits (opening parts) 45 are formed at predetermined intervals along the periphery of the position detecting plate 33. The intervals may be spaced evenly or differently according to necessity. The position detecting plate 33, being fixed to the rotary axle 41, rotates (oscillates) in correspondence with the rotation of the rotary axle 41. As shown in FIG. 3A, the photo-interrupter 34 (in this example, shaped as a square bracket) is provided in a manner clamping the position detecting plate 33. The photo-interrupter 34 is provided with a light emitting part (not shown) and a light receiving part (not shown) for detecting the slits 45 of the position detecting plate 33. Accordingly, the rotation angle (oscillation angle) of the control panel 4 can be determined by detecting and counting the slits 45 of the position detecting plate 33 with use of the photo-interrupter 34.

Figure 13:
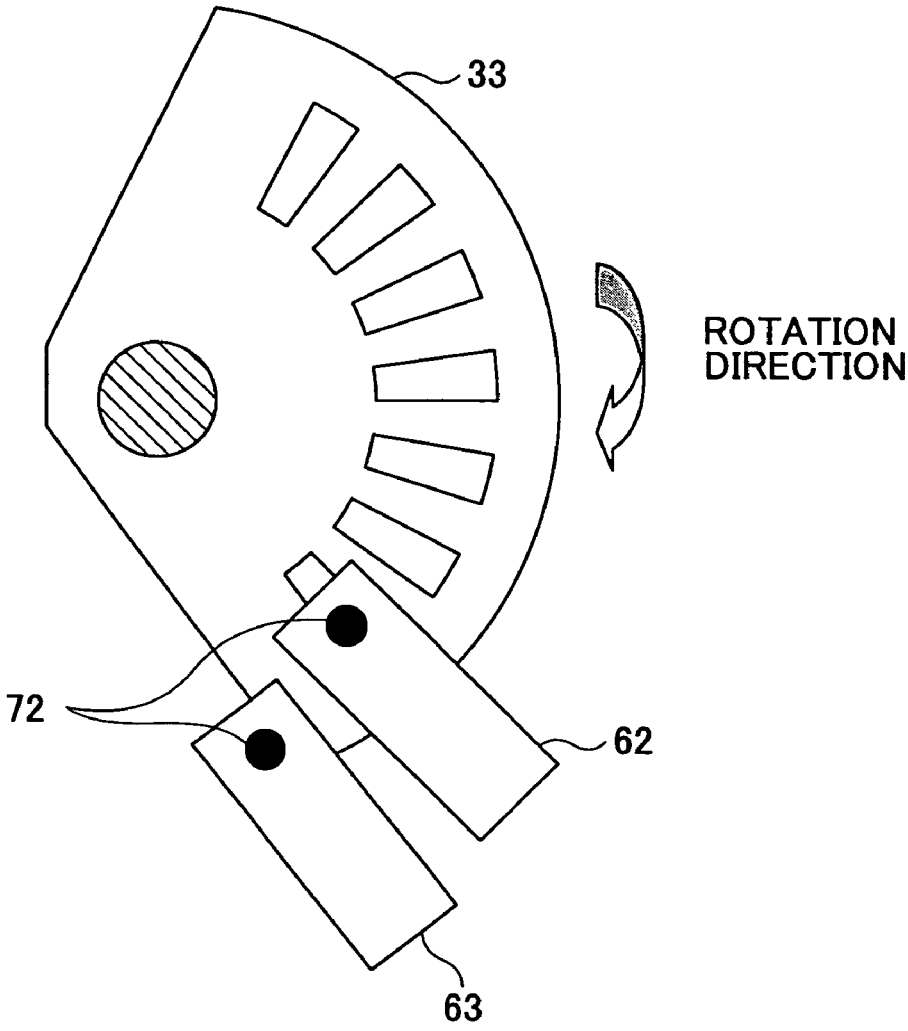
FIG. 13 is a diagram showing the positional relationship between a position detecting plate and a position sensor and a reference position detecting sensor a included in a photo-interrupter according to an embodiment of the present invention.

FIG. 13 shows the positional relationship between the position detecting plate 33 and the position sensor 62 and the reference position detecting sensor 63 included in the photo-interrupter 34. The slits 45 of the position detecting plate 33 are arranged to match detecting positions 72 of the photo-interrupter 34. Accordingly, the slits 45 are detected along with the rotation of the position detecting plate 33, to thereby determine the tilt angle of the control panel 4.

FIG. 13 shows the position detecting plate 33 in a case where the control panel 4 is positioned in a horizontal state, that is, a state where the control panel 4 is rotated upward to the highest position (initial position). The position detecting plate 33 is rotated in the arrow direction shown in FIG. 13 in correspondence with the tilting movement (rotating movement) of the control panel 4. The angular position (rotation angle) of the control panel 4 can be determined by counting the number of slits 45 from the initial position. Furthermore, the angular position (rotation angle) of the control panel 4 can be determined more reliably by employing the reference position sensor 63 for detecting the position of a predetermined reference position.

Figure 14:
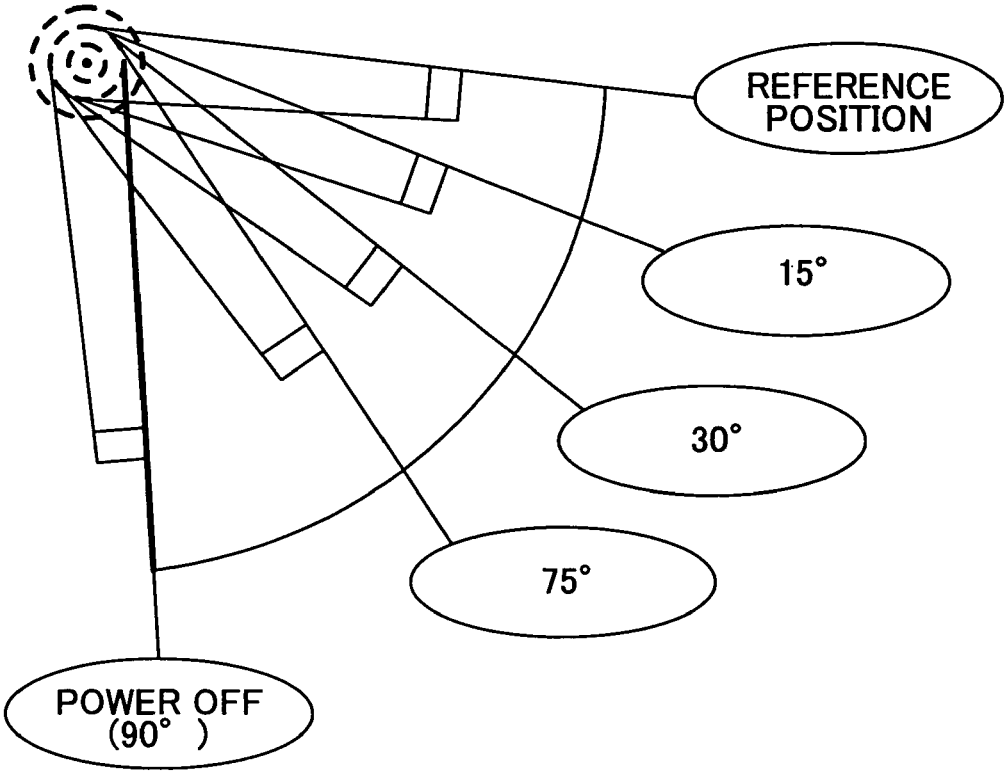
FIG. 14 is a diagram showing an image of the rotation of a control panel where plural tilt angles of the control panel are set beforehand according to an embodiment of the present invention.

FIG. 14 is a diagram showing an image of the rotation of the control panel 4 where plural angles (angular positions) of the control panel 4 are set beforehand. By setting the angular positions beforehand, the control panel 4 can be arranged at a desired angular position when the image processing apparatus 100 is turned on/off before or after performing a predetermined operation. Furthermore, the control panel 4 can be adjusted to a desired angular position repeatedly (repetition of angle adjustment).

Figure 15:
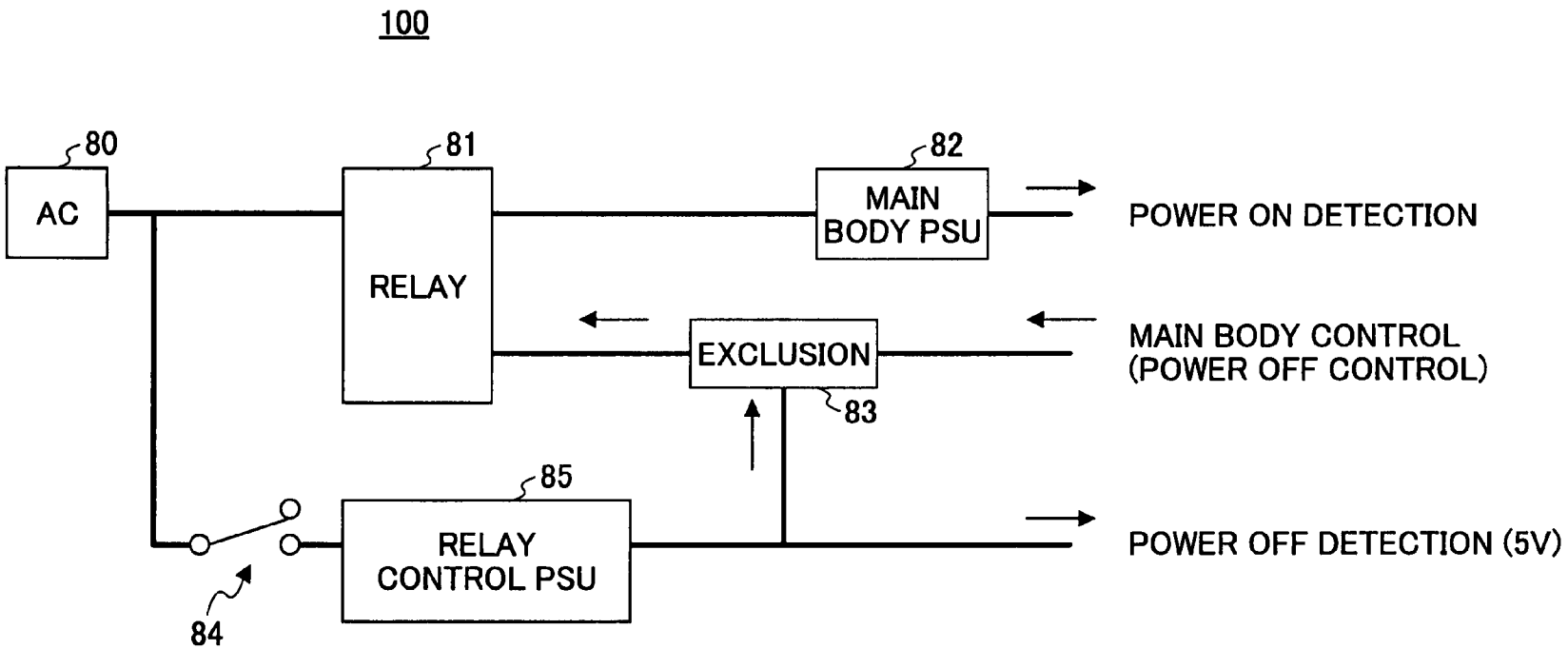
FIG. 15 is a schematic diagram showing control blocks of an image processing apparatus for controlling the applying/interrupting of power to an apparatus PSU (Power Supply Unit) in a case where an external power supply and a relay is used in the image processing apparatus according to an embodiment of the present invention.

FIG. 15 is a schematic diagram showing control blocks of the image processing apparatus 100 for controlling the applying/interrupting of power to an apparatus PSU (Power Supply Unit) in a case where an external power supply and a relay is used in the image processing apparatus 100 according to an embodiment of the present invention. The exemplary configuration of the image processing apparatus 100 shown in FIG. 15 includes an AC power supply 80, a relay part 81, a main body PSU 82, an exclusion part 83, a main SW (switch) 84, and a relay control PSU (e.g. DC power supply) 85. Next, with reference to FIGS. 16-19, an operation of the control panel 4 (control part 400) is described in a situation where a POWER ON signal or a POWER OFF signal detected.

[Power On Operation]

Figure 16:
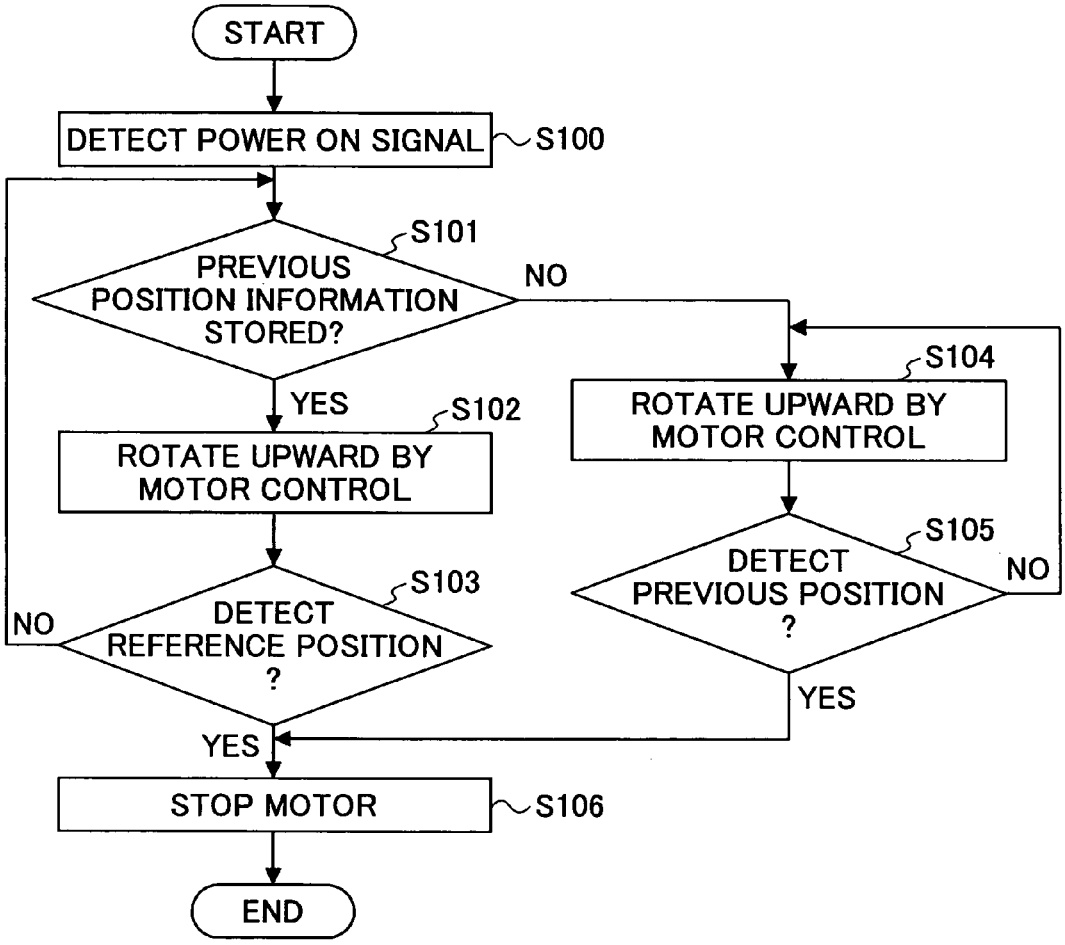
FIG. 16 is a flowchart for describing the operation of a control part in a case of switching on the power of an image processing apparatus according to an embodiment of the present invention.
Figure 17:
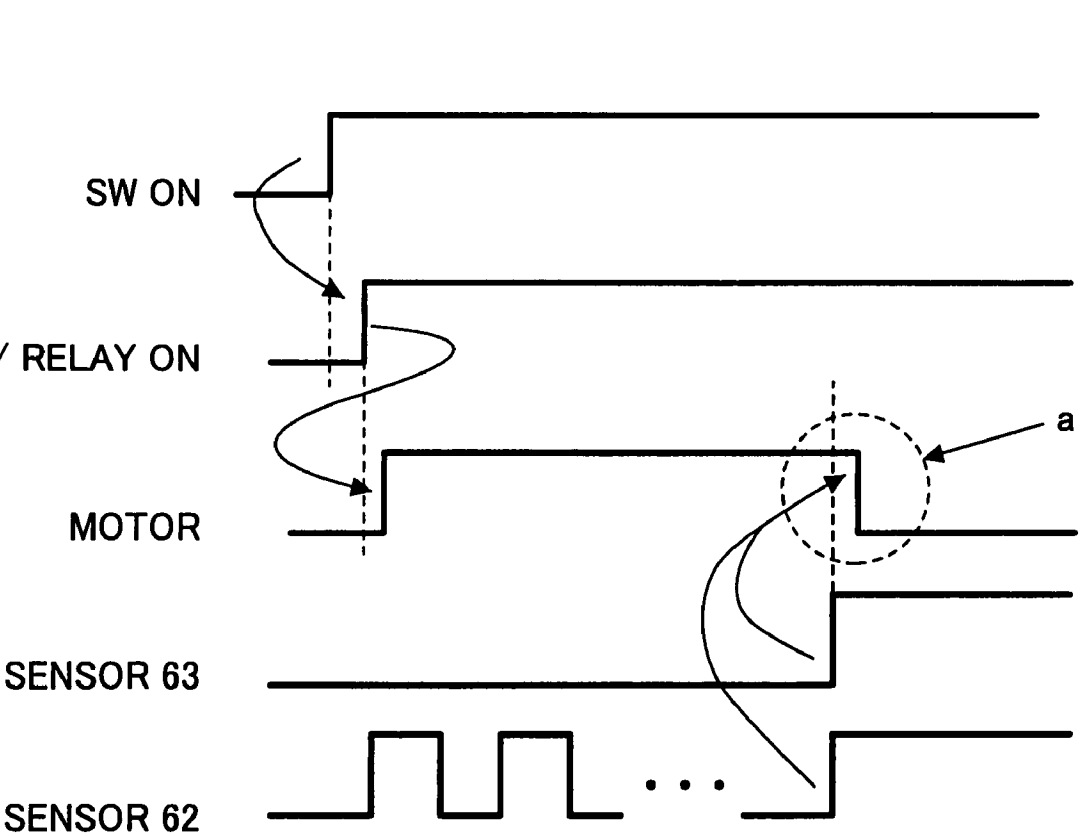
FIG. 17 is a timing chart for describing an operation of a control part in a case of switching on the power of an image processing apparatus according to an embodiment of the present invention.

FIG. 16 is a flowchart for describing the operation of the control part 400 in a case of switching on the power of the image processing apparatus 100 according to an embodiment of the present invention. FIG. 17 is a timing chart for describing the operation of the control part 400 in a case of switching on the power of the image processing apparatus 100 according to an embodiment of the present invention. In the operation shown in FIG. 16, a signal indicative of the electric power of the image processing apparatus 100 is detected. In a case where a Power On signal is detected (Step S100), it is determined whether a previous position data of the control panel 4 is recorded, for example, in the memory part 17 (Step S101). In a case where previous position data is recorded (Yes in Step S101), the control panel 4 is rotated upward by controlling the motor 30 (Step S102). Then, the position of the control panel 4 is detected (Step S103). In a case where the reference position of the control panel 4 is detected (Yes in Step S103), the motor 30 is stopped (Step S106). As shown in FIG. 17, the motor 30 is stopped at timing "a" when the position sensor 62 detects the reference position. In a case where the reference position of the control panel 4 cannot be detected (No in Step S103), the operation returns to Step S102 to continue controlling the motor and finding the reference position. Meanwhile, in a case where previous position data is not recorded (No in Step S101), the control panel 4 is rotated upward by controlling the motor 30 (Step S104). Then, the position of the control panel 4 is detected (Step S105). In a case where the position sensor 62 detects the previous position of the control panel 4 (Yes in Step S105), the motor 30 is stopped (Step S106). In a case where the previous position of the control panel 4 cannot be detected (No in Step S105), the operation returns to Step S104 to continue controlling the motor and finding the previous position.

With the above-described operation, the control panel 4 can be set to a predetermined position when the power of the image processing apparatus 100 is turned on. Accordingly, operation of the control panel 4 can be performed in the same manner as the previous time.

[Power Off Operation]

Figure 18:
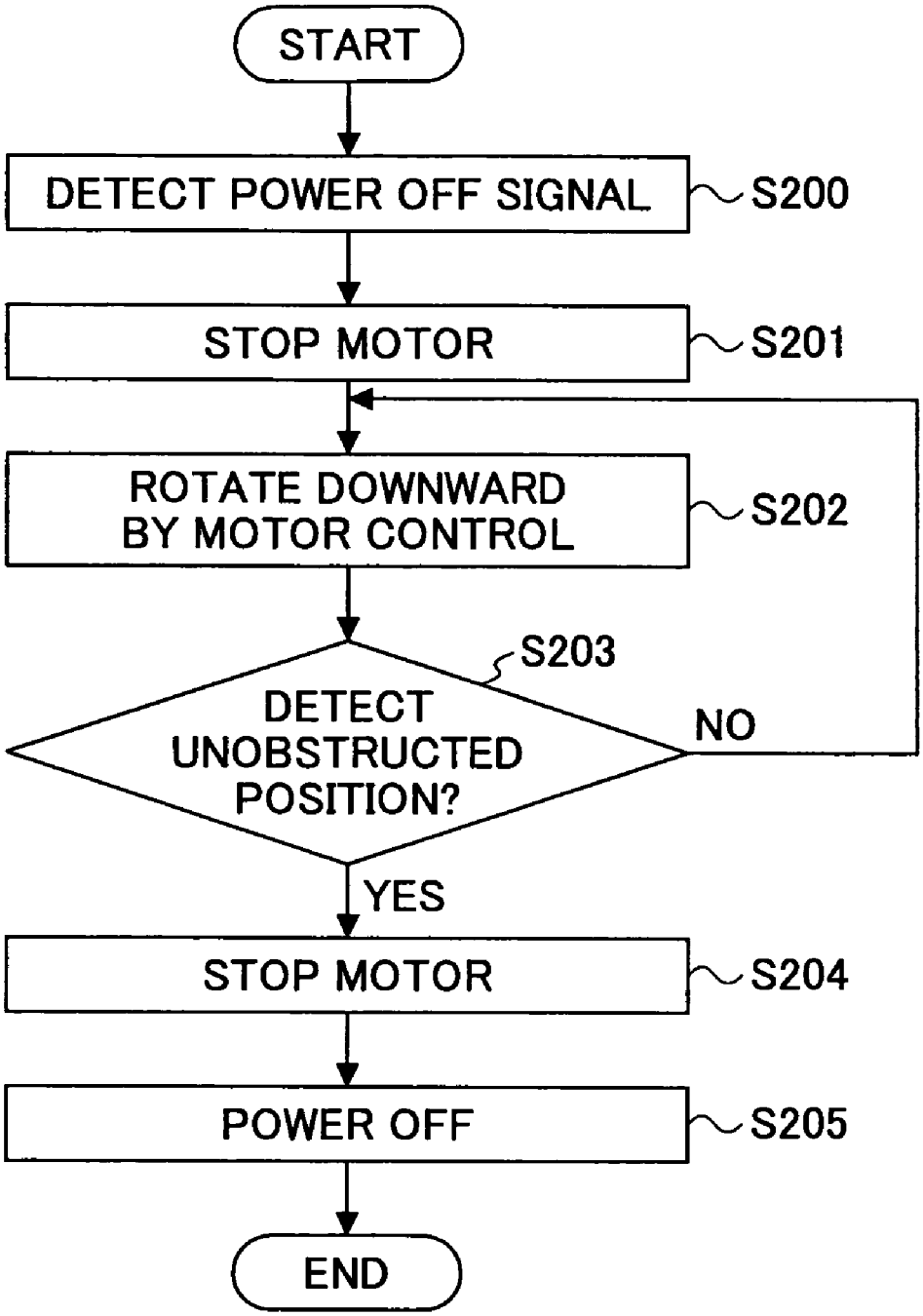
FIG. 18 is a flowchart for describing an operation of a control part in a case of switching off the power of an image processing apparatus according to an embodiment of the present invention.
Figure 19:
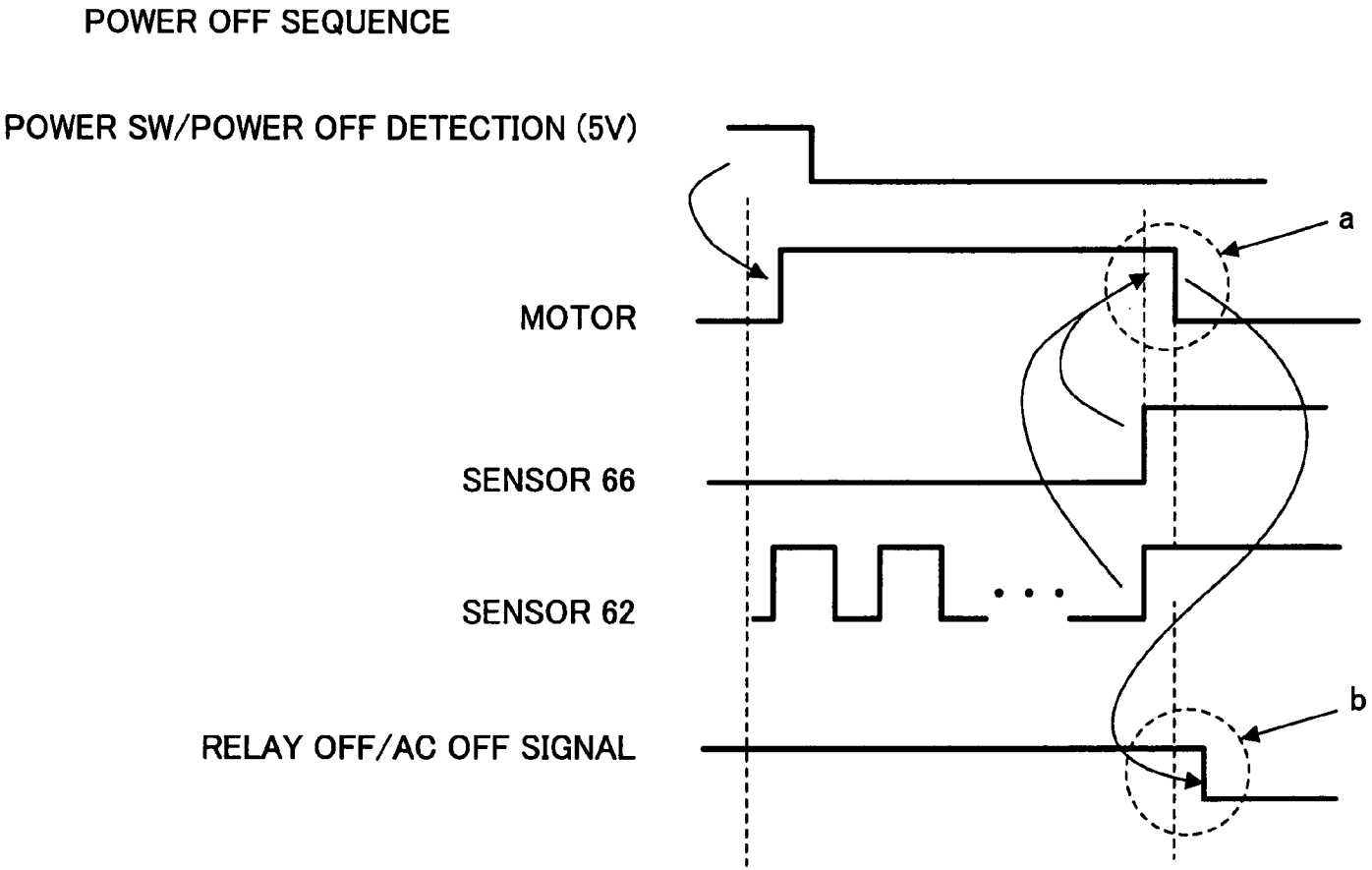
FIG. 19 is a timing chart for describing an operation of a control part in a case of switching off the power of an image processing apparatus according to an embodiment of the present invention.

FIG. 18 is a flowchart for describing the operation of the control part 400 in a case of switching off the power of the image processing apparatus 100 according to an embodiment of the present invention. FIG. 19 is a timing chart for describing the operation of the control part 400 in a case of switching off the power of the image processing apparatus 100 according to an embodiment of the present invention.

In the operation shown in FIG. 18, a signal indicative of the electric power of the image processing apparatus 100 is detected. In a case where a Power OFF signal is detected (Step S200), the motor 30 is stopped (Step S201). Then, the control panel 4 is rotated downward by controlling the motor 30. In a case where a predetermined position (an unobstructed position where the control panel 4 is not an obstruction when not used) is detected by a predetermined position sensor 66 (Yes in Step S203), the motor 30 is stopped (Step S204). Then, the power of the image processing apparatus 100 is turned off (Step S205). In FIG. 19, the motor 30 is driven when a Power SW/Power Off signal is detected and is stopped when the predetermined position sensor 66 detects the predetermined position (see timing "a" of FIG. 19). The relay off/AC off signal stops when the motor 33 stops (see timing "b" of FIG. 19).

With the above-described operation, the control panel 4 can be set to the unobstructed position in a case of turning off the power of the image processing apparatus 100 according to an embodiment of the present invention. Accordingly, the control panel 4 can be set at a desired position (e.g. unobstructed position, space-saving position, easy operating position, visible position) when the image processing apparatus 100 is turned on/off before or after performing a predetermined operation. As a result, the image processing apparatus 100 including the control panel 4 can be handled in safe and space-saving manner.

By setting the angular positions beforehand, the control panel 4 can be arranged at a desired angular position when the image processing apparatus 100 is turned on/off before or after performing a predetermined operation.

Furthermore, with the above-described control part 400 according to an embodiment of the present invention, the operator can easily set the position of the control part 400 (control panel 4) since both the downward oscillation and the upward oscillation of the control part 400 are performed in a similar manner.

The above-described control part 400 according to an embodiment of the present invention may be applied to a rotary angle adjusting mechanism of various office automation equipments (e.g. copier, printer, etc.) and electronic devices.

It is to be noted that the processes (steps) of the flowcharts shown in FIGS. 16 and 18 may be performed with a program for causing a computer or a CPU of other systems to execute the above-described angular position adjusting operation of the control part 400 (control panel 4). The program may be recorded, for example, in the memory part 17 or a computer-readable recording medium 800 (as shown in FIG. 2).

For example, the program according to an embodiment of the present invention includes the processes of a) detecting an instruction (request) for turning off the power of the image processing apparatus, b) determining the angular position of the control panel 4, c) determining whether the angular position of the control panel 4 is set to a maximum tilt angle, d) immediately turning off the power when it is determined that the angular position is set to the maximum tilt angle and generating a tilt operation instructing signal for changing the angular position when it is determined that the angular position is not set to the maximum tilt angle, and e) stopping the tilt operation and generating a power off instructing signal when the angular position reaches the maximum tilt angle. The program may also include the processes of f) storing the angular positions of the control panel 4 in the memory part and g) generating a power off signal when the angular position reaches a predetermined angular position stored in the memory part.

The program according to another embodiment of the present invention includes the processes of a) detecting the turning on of the power of the image processing apparatus 100, b) detecting the angular position of the control panel, c) adjusting the angular position of the control panel to a minimum tilt angle and stopping the adjustment when the angular position reaches the minimum tilt angle when the turning on of power is detected (detection of power on signal).

The program according to yet another embodiment of the present invention includes the processes of a) reading out data containing reference position of the control panel 4 from the memory part, b) comparing the angular position of the control panel 4 with the angular position of the reference position data, c) reading out the reference position data from the memory part when turning on the power of the image processing apparatus 100, d) comparing the read out reference position data and the angular position of the control panel 4 and adjusting the angular position of the control panel 4 to the angular position in the reference position data, and e) stopping the adjustment when the angular position reaches the angular position in the reference position data.

In addition, the program according to one of the above-described embodiments of the present invention may also include the processes of: storing the angular position of the control panel 4 in the memory part before turning off the power of the image processing apparatus 100; reading out the stored angular position as the reference position data from the memory part; comparing the angular position of the control panel 4 and the angular position in the reference position data; reading out the reference position data from the memory part when the turning on of power is detected; comparing the read out angular position in the reference position data with the angular position of the control panel 4; adjusting the angular position until the angular position of the control panel 4 reaches the angular position in the reference position data; and stopping the adjustment when the angular position of the control panel 4 reaches the angular position in the reference position data.

Further, the present invention is not limited to these embodiments, but variations and modifications may be made without departing from the scope of the present invention.

The present application is based on Japanese Priority Application No. 2005-269215 filed on Sep. 15, 2005, with the Japanese Patent Office, the entire contents of which are hereby incorporated by reference.

What is claimed is:

1. An apparatus for adjusting a variable angular position of a control panel of an image processing apparatus, the angular position adjusting apparatus comprising:

a rotary member attached to the control;

an input part for generating an input signal indicative of selecting the variable angular position of the control panel to any position between a fully opened position and a fully closed position;

a motor part connected to the rotary member for changing the variable angular position of the control panel by driving the rotary member;

a setting part for setting the variable angular position of the control panel in correspondence with a power status of the image processing apparatus;

an angle position detecting part including a position sensor for detecting at least one angular position of the control panel;

a stop position detecting part for determining whether the variable angular position of the control panel has reached a selected angular position;

an input signal detecting part for detecting the input signal generated from the input part;

a motor driving part for driving the motor in accordance with the input signal detected by the input signal detecting part; and a braking part for immediately stopping the rotation of the control panel upon reaching the selected variable angular position at any position between a fully opened position and a fully closed position, wherein the setting part sets the angular position of the control panel to a vertical position in a case of turning off the power of the image processing apparatus.

2. The angular position adjusting apparatus as claimed in claim 1, wherein the setting part sets the variable angular position of the control panel to a predetermined angular position in a case of turning on the power of the image processing apparatus.

3. The angular position adjusting apparatus as claimed in claim 2, further comprising:

a memory part for storing data of the angular position of the control panel before the power of the image processing apparatus is turned off, wherein the data includes data of the predetermined angular position.

4. The angular position adjusting apparatus as claimed in claim 1, wherein the input part is situated on at least one of an upper surface of the control panel and a lower surface of the control panel, wherein the input part generates the input signal in accordance with a pressing force applied from an operator of the image processing apparatus.

5. A method for adjusting a variable angular position of a control panel of an image processing apparatus, the method comprising:

generating an input signal indicative of selecting the variable angular position of the control panel at any position between a fully opened position and a fully closed position;

changing the variable angular position of the control panel by driving a rotary member attached to the control panel;

setting the variable angular position of the control panel in correspondence with a power status of the image processing apparatus;

detecting at least one angular position of the control panel;

determining whether the variable angular position of the control panel has reached a selected angular position;

detecting the input signal generated from the input part;

driving the motor in accordance with the input signal detected during detecting the input signal; and immediately stopping the rotation of the control panel by a braking part upon reaching the selected angular position at any position between a fully opened position and a fully closed position, wherein setting the angular position sets the angular position of the control panel to a vertical position in a case of turning off the power of the image processing apparatus.

6. The method as claimed in claim 5, wherein setting the angular position sets the angular position of the control panel to a predetermined angular position in a case of turning on the power of the image processing apparatus.

7. The method as claimed in claim 6, further comprising:

storing data of the angular position of the control panel before the power of the image processing apparatus is turned off, wherein the data includes data of the predetermined angular position.

8. The method as claimed in claim 5, wherein generating an input signal generates the input signal in accordance with a pressing force applied from an operator of the image processing apparatus.

9. A computer-readable non-transitory storage medium on which a program is recorded for causing a computer to execute an angular position adjusting method for adjusting a variable angular position of a control panel of an image processing apparatus, the method comprising:

generating an input signal indicative of selecting the variable angular position of the control panel at any position between a fully opened position and a fully closed position;

changing the variable angular position of the control panel by driving a rotary member attached to the control panel;

setting the angular position of the control panel in correspondence with a power status of the image processing apparatus;

detecting at least one angular position of the control panel;

determining whether the angular position of the control panel has reached a selected angular position;

detecting the input signal generated from the input part;

driving the motor in accordance with the input signal detected during detecting the input signal; and immediately stopping the rotation of the control panel by a braking part upon reaching the selected angular position at any position between a fully opened position and a fully closed position, wherein setting the angular position sets the angular position of the control panel to a vertical position in a case of turning off the power of the image processing apparatus.

* * * * *